US006638104B2

(12) United States Patent
Hashimoto et al.

(10) Patent No.: US 6,638,104 B2
(45) Date of Patent: Oct. 28, 2003

(54) ELECTRICAL CONNECTOR

(75) Inventors: Shinichi Hashimoto, Kanagawa (JP); Naotaka Sasame, Tokyo (JP)

(73) Assignee: Tyco Electronics, AMP, K.K., Kanagawa (JP)

( * ) Notice: Subject to any disclaimer, the term of this patent is extended or adjusted under 35 U.S.C. 154(b) by 0 days.

(21) Appl. No.: 10/109,123

(22) Filed: Mar. 27, 2002

(65) Prior Publication Data

US 2002/0142651 A1 Oct. 3, 2002

(30) Foreign Application Priority Data

Mar. 29, 2001 (JP) ..... 2001-097608

(51) Int. Cl.[7] ..... H01R 13/60

(52) U.S. Cl. ..... 439/567; 439/79; 439/573; 439/954

(58) Field of Search ..... 439/567, 954, 439/575, 555, 569–570, 552, 564, 573, 79, 572, 892

(56) References Cited

U.S. PATENT DOCUMENTS

| | | | | |
|---|---|---|---|---|
| 5,971,774 A | * | 10/1999 | Kuki et al. | 439/79 |
| 6,012,952 A | | 1/2000 | Choy et al. | 439/637 |
| 6,027,372 A | | 2/2000 | Lai et al. | 439/573 |
| 6,116,917 A | * | 9/2000 | Choy | 439/79 |
| 6,168,464 B1 | * | 1/2001 | Choy et al. | 439/567 |
| 6,171,142 B1 | | 1/2001 | Wang et al. | 439/567 |
| 6,345,992 B1 | * | 2/2002 | Cheong et al. | 439/892 |
| 6,540,540 B1 | * | 4/2003 | Tobey | 439/567 |
| 6,551,116 B1 | * | 4/2003 | Liu | 439/567 |

FOREIGN PATENT DOCUMENTS

| | | | |
|---|---|---|---|
| JP | 1987-18984 | 2/1987 | H01R/23/68 |
| JP | 1988-192689 | 12/1988 | H01R/23/68 |

* cited by examiner

*Primary Examiner*—Renee Luebke
*Assistant Examiner*—Felix O. Figueroa
(74) *Attorney, Agent, or Firm*—Barley, Snyder, Senft & Cohen, LLC

(57) ABSTRACT

An electrical connector (1) comprising a housing (10) having a board attachment face (13*a*) inclined a specified angle from a plane that is perpendicular to a direction of mating with a mating connector. Contacts (20) are connected to the housing (10) and have leg parts (24) that extend parallel to the direction of mating that are inserted into a circuit board. A leg part alignment plate (30) aligns the leg parts (24) and is movable along the direction of mating. A fastening fitting (40) has a screw attachment plate part (41) that extends parallel to the board attachment face (13*a*) and a female screw part (45) that extends perpendicular to the board attachment face (13*a*) that is formed in the approximate center of the screw attachment plate part (41). Anchoring leg parts (44) are connected to the screw attachment plate part (41) and extend parallel to the direction of mating.

15 Claims, 10 Drawing Sheets

ELECTRICAL CONNECTOR

BACKGROUND OF THE INVENTION

The present invention relates to an electrical connector and, more specifically, to an electrical connector designed so that the direction of mating with a mating connector is inclined with respect to a circuit board.

DESCRIPTION OF THE PRIOR ART

In the past, a technique has been known in which two circuit boards are connected to each other, or a circuit board and electrical wires are connected to each other, by the mutual mating of a set consisting of an electrical connector and a mating connector. In connecting the two circuit boards to each other, or connecting the circuit board and the electrical wires to each other, an approach is generally used in which a board attachment face in a housing of the electrical connector is oriented perpendicular to the direction of mating with the mating connector, so that the direction of mating with the mating connector is oriented perpendicular to the circuit board.

However, depending on the application in which the electrical connector and the mating connector are mounted, there may be cases in which it is necessary to incline the board attachment face in the housing of the electrical connector by a specified angle from the plane that is perpendicular to the direction of mating with the mating connector, so that the mating direction is inclined with respect to the circuit board. First and second examples of conventional electrical connectors of this type are shown in FIGS. 14 and 15.

A first example of a conventional electrical connector of this type is shown in FIG. 14 (see Japanese Utility Model Application Kokai No. S62-18984). The electrical connector 200 is constructed from a housing 210 having a plurality of contacts 220 attached to the housing 210 in two rows. The housing 210 comprises a mating face 210*a* that mates with a mating connector 250 to which electrical wires W are connected and a board attachment face 210*b* that is attached to a circuit board PCB. The board attachment face 210*b* is formed so that the board attachment face 210*b* is inclined by a specified angle of $\alpha°$ from a plane that is perpendicular to the direction of mating with the mating connector 250 (which coincides with the normal direction of the mating face 210*a*).

Each contact 220 is constructed from an attachment part 221 that is attached to the housing. A contact part 222 extends from one end of the attachment part 221 and makes contact with the mating connector 250. A connecting part 223 extends from the other end of the attachment part 221 and is connected to the circuit board PCB. The contact part 222 extends parallel to the direction of mating with the mating connector 250 (which coincides with the normal direction of the mating face 210*a*), and the attachment part 221 and connecting part 223 extend in a direction perpendicular to the board attachment face 210*b*.

The electrical connector 200 is manufactured by bending the respective contact parts 222 all at one time relative to the attachment parts 221 after the attachment parts 221 of the respective contacts 220 have been press-fitted in the housing 210. Then, the electrical connector 200 is mounted on the circuit board PCB by passing the connecting parts 223 of the contacts 220 through the through-holes (not shown) of the circuit board PCB and making solder connections.

Shown in FIG. 15 is a second example of an electrical connector in which the board attachment face is inclined by a specified angle from the plane perpendicular to the direction of mating with the mating connector (see Japanese Utility Model Application Kokai No. S63-192689). The electrical connector 300 is constructed from a housing 310, and a plurality of contacts 320 that are attached to the housing 310 in a single row. The housing 310 comprises a mating face 310*a* that mates with a mating connector (not shown) to which electrical wires (not shown) are connected, and a board attachment face 310*b* which is attached to a circuit board (not shown). The board attachment face 310*b* is formed so that the board attachment face 310*b* is inclined by a specified angle of $\alpha°$ from the plane that is perpendicular to the direction of mating with the mating connector (which coincides with the normal direction of the mating face 310*a*).

Each contact 320 is constructed from an attachment part 321 that is attached to the housing 310. A contact part 322 extends from one end of the attachment part 321 and makes contact with the mating connector. A connecting part 323 extends from the other end of the attachment part 321 and is connected to the circuit board. The contact part 322 extends parallel to the direction of mating with the mating connector (which coincides with the normal direction of the mating face 310*a*), while the attachment part 321 and connecting part 323 extend in a direction that is perpendicular to the board attachment face 310*b*.

The electrical connector 300 is manufactured by bending the contact parts 322 of the respective contacts 320 relative to the attachment parts 321, and then insert-molding root portions of the attachment parts 321 and contact parts 322 in the housing 310. Then, the electrical connector 300 is mounted on the circuit board by passing the contact parts 323 of the contacts 320 through the through-holes (not shown) of the circuit board and making solder connections.

However, the following problems have been encountered in the conventional electrical connectors 200 and 300 shown in FIGS. 14 and 15. Specifically, in both of the conventional electrical connectors 200 and 300 shown in FIGS. 14 and 15, it is necessary that the contact parts 222, 322 of the contacts 220, 320 be bent by an angle of $\alpha°$ with respect to the attachment parts 221, 321. Since a spring-back effect occurs during this bending, it is difficult to bend all of the contact parts 222, 322 of the contacts 220, 320 to the appropriate angle with good precision. Furthermore, since there is some variation in the amount of spring-back among the individual contacts 220, 320, it is impossible to bend the contact parts 222, 322 of all of the contacts 220, 320 to the appropriate angle with good precision by means of a single bending operation. Accordingly, there may be cases in which a separate bending operation is necessary in order to improve the precision of the bending angle of the contact parts 222, 322, resulting in a higher manufacturing cost.

It is therefore desirable to develop an electrical connector in which the direction of mating with the mating connector is inclined with respect to the circuit board so that there is no need to bend the leg parts of the numerous contacts at an inclination with respect to the direction of mating with the mating connector. In an electrical connector of this type, the location of the connector parts can be controlled and an increase in the cost of manufacture caused by such a bending process can be avoided.

SUMMARY OF THE INVENTION

The invention is directed to an electrical connector having a housing with a board attachment face inclined a specified angle from a plane that is perpendicular to a direction of mating with a mating connector. Contacts are connected to the housing and have leg parts that extend parallel to the direction of mating that are inserted into a circuit board. A leg part alignment plate aligns the leg parts and is movable along the direction of mating. A fastening fitting has a screw attachment plate part that extends parallel to the board attachment face and a female screw part that extends perpendicular to the board attachment face that is formed in the approximate center of the screw attachment plate part. Anchoring leg parts are connected to the screw attachment plate part and extend parallel to the direction of mating.

The invention is also directed to an electrical connector having a housing with a board attachment face inclined by a specified angle from a plane that is perpendicular to a direction of mating with a mating connector and a nut accommodating hole that extends parallel to the board attachment face. Contacts are connected to the housing and have leg parts that extend parallel to the direction of mating that are inserted into first through-holes in a circuit board. A leg part alignment plate has second through-holes that align the leg parts and is movable along the direction of mating. A nut having a female screw part is oriented in a direction that extends perpendicular to the board attachment face when the nut is inserted into the nut accommodating hole.

BRIEF DESCRIPTION OF THE DRAWINGS

FIG. 1(A) is a plan view,

FIG. 1(B) is a front view, and

FIG. 1(C) is right-side view.

FIG. 4(A) is a plan view, and

FIG. 4(B) is a front view.

FIG. 6(A) is a plan view,

FIG. 6(B) is a front view,

FIG. 6(C) is a left-side view, and

FIG. 6(D) is a right-side view.

FIG. 7 shows a state in which the electrical connector shown in FIG. 1 is mounted on a circuit board;

FIG. 8 shows a second working configuration of the electrical connector of the present invention;

FIG. 10(A) is a plan view,

FIG. 10(B) is a front view, and

FIG. 10(C) is a right-side view.

FIG. 11(A) is a left-side view,

FIG. 11(B) is a plan view, and

FIG. 11(C) is a front view.

FIG. 14(A) is a side view, and

FIG. 14(B) is a side view which shows a state in which a mating connector is engaged with the electrical connector mounted on a circuit board.

FIG. 15(A) is a perspective view, and

FIG. 15(B) is a sectional view.

DETAILED DESCRIPTION OF THE PREFERRED EMBODIMENT

Figure 1:
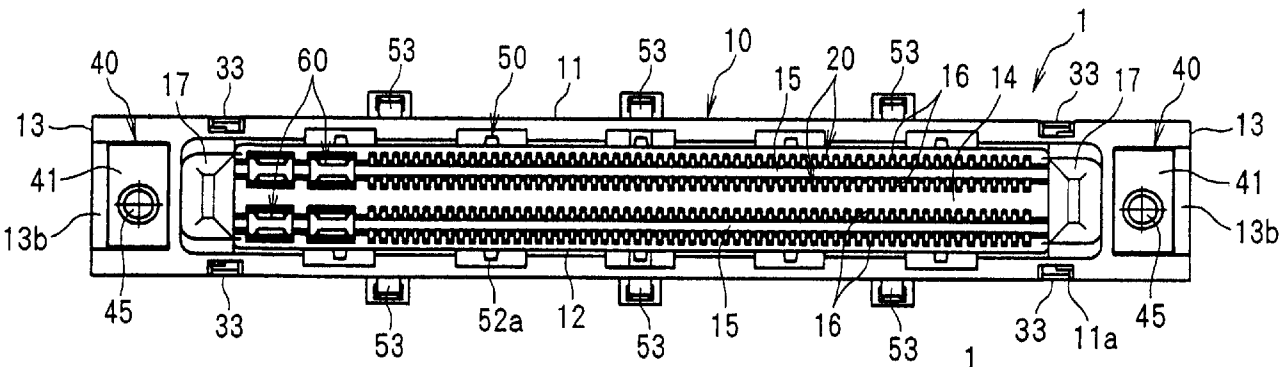
FIG. 1 shows a first working configuration of the electrical connector of the present invention.
Figure 1:
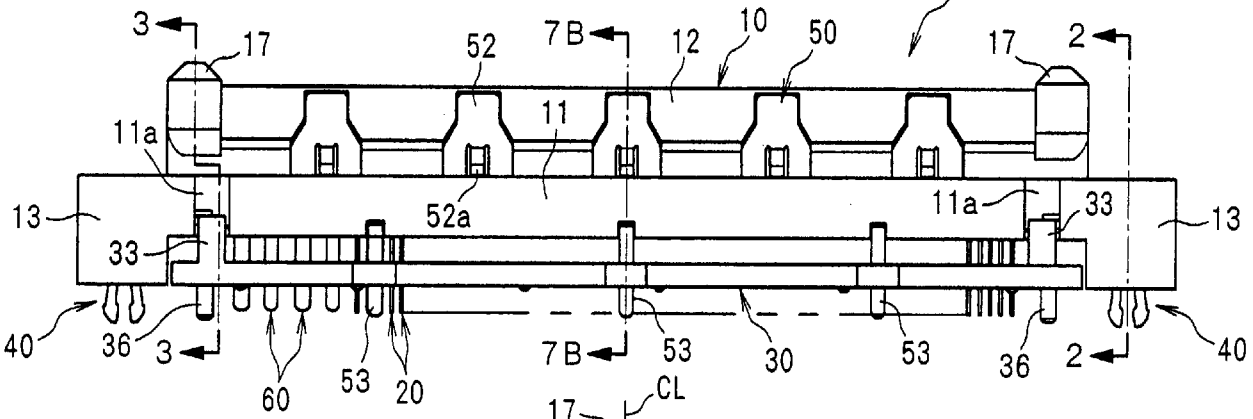
Figure 1:
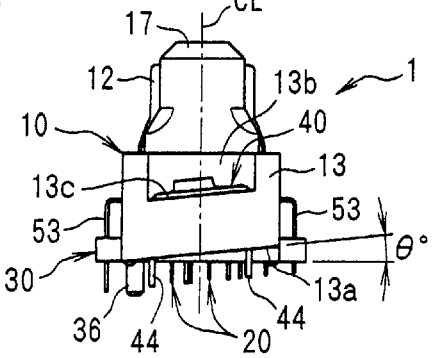

Working configurations of the present invention will now be described with reference to the attached figures. FIG. 1 shows a first example of a working configuration of an electrical connector of the present invention. As shown in FIG. 1, the electrical connector 1 comprises a housing 10, numerous contacts 20, a leg part alignment plate 30, a pair of fastening fittings 40, and a metal shell 50.

The housing 10 comprises a substantially rectangular base part 11 that extends in the direction of length (i.e., the left-right direction in FIG. 1(A)) and a substantially rectangular mating part 12 that extends upward from the upper surface of the base part 11. The housing 10 may be formed by molding an insulating resin.

A pair of board attachment parts 13 protrude downward from the bottom surface of the base part 11 and are disposed on both end portions of the base part 11 with respect to the direction of length of the base part 11. Board attachment faces 13*a* are formed on the bottom surfaces of the respective board attachment parts 13 and are inclined by a specified angle of θ° with respect to a plane that is perpendicular to the direction of mating with a mating connector (not shown) (i.e., the direction in which the central axis CL extends in FIG. 1(C) and FIG. 2). The board attachment faces 13*a* are inclined so that the board attachment faces 13*a* gradually run upward from the front faces of the board attachment parts 13 (i.e., the left faces in FIG. 1(C) and FIG. 2) toward the rear faces of the board attachment parts 13.

Figure 2:
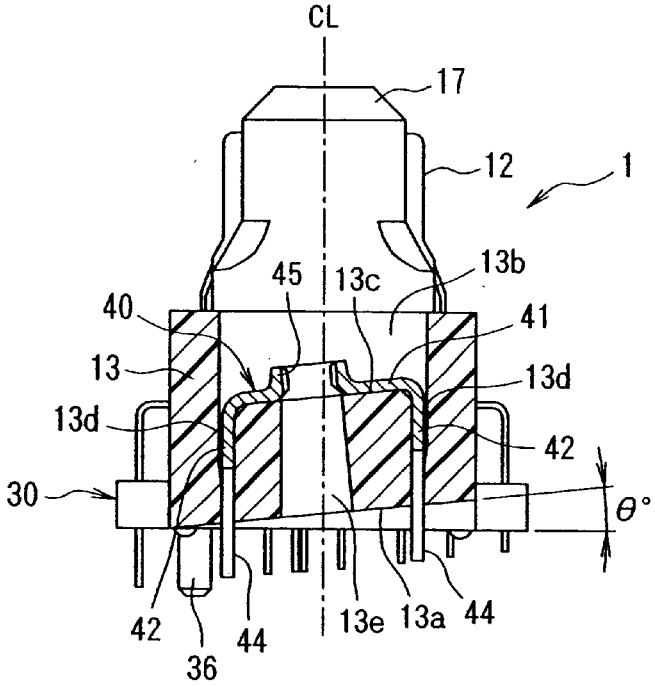
FIG. 2 is a sectional view along line 2—2 in FIG. 1(B).

A fastening fitting accommodating recess 13*b*, which is recessed downward from the upper surface of the corresponding board attachment part 13, is formed in each board attachment part 13. The bottom surface 13*c* of the fastening fitting accommodating recess 13*b* is formed parallel to the corresponding board attachment face 13*a*. As shown in FIGS. 2 and 4(A), a pair of fastening fitting press-fitting through-holes 13*d* are formed in the front and rear end portions of the bottom surface 13*c* of each fastening fitting accommodating recess 13*b*. The respective fastening fitting press-fitting through-holes 13*d* extend parallel to the direction of mating with the mating connector.

As shown most clearly in FIG. 2, a screw insertion hole 13*e* which communicates between the bottom surface 13*c* of the fastening fitting accommodating recess 13B and the board attachment face 13*a*, is formed in the approximate center of the bottom surface 13*c* of each fastening fitting accommodating recess 13*b*. The screw insertion hole 13*e* is formed in the mold removal direction along the direction of mating. Accordingly, a slide mold is not needed to form the screw insertion holes 13*e*, so that the manufacturing cost of the housing 10 can be lowered.

Figure 3:
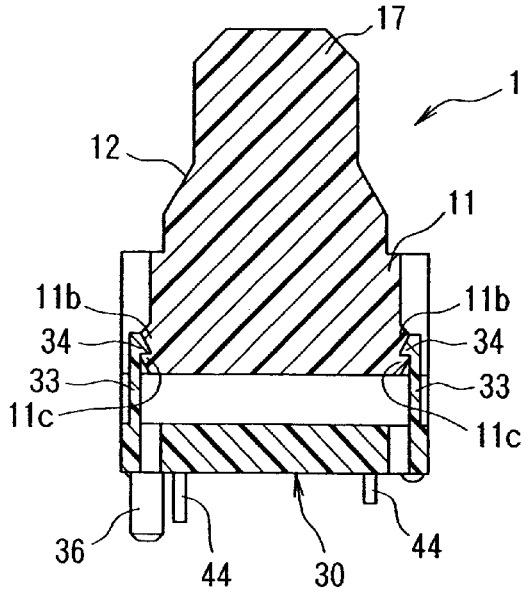
FIG. 3 is a sectional view along line 3—3 in FIG. 1(B).
Figure 4:
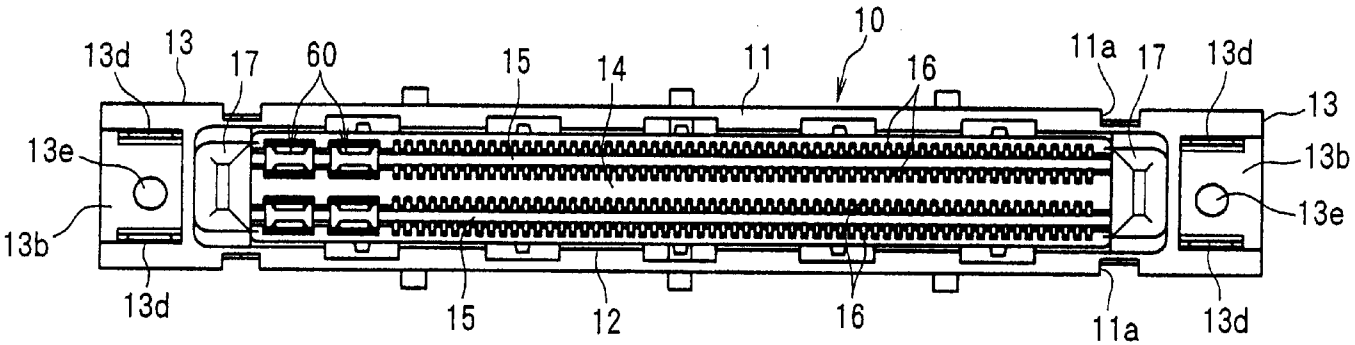
FIG. 4 shows the electrical connector shown in FIG. 1 with the fastening fittings and leg part alignment plate removed.
Figure 4:
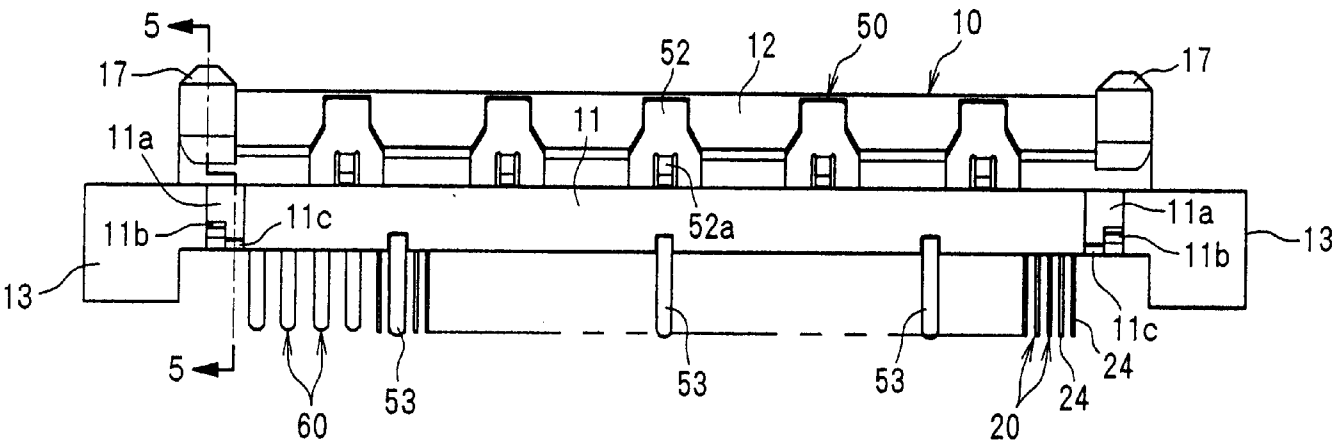
Figure 5:
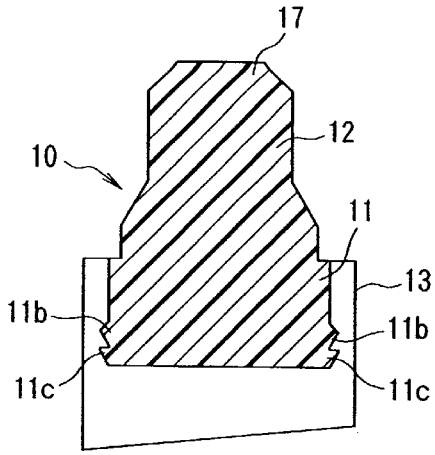
FIG. 5 is a sectional view along line 5—5 in FIG. 4(B).

As shown in FIGS. 1 and 4, two pairs of grooves 11*a*, which allow anchoring arms 33 of the leg part alignment plate 30 to move along the direction of mating with the mating connector, are formed in both end portions of the front and rear faces of the base part 11. As shown in FIGS. 3, 4 and 5, anchoring projections 11*b* and 11*c* are positioned above and below anchoring projections 34 of the anchoring arms 33. The anchoring projections 11*b* and 11*c* temporarily anchor the leg part alignment plate 30 and are formed to protrude into the respective grooves 11*a*.

Figure 7A:
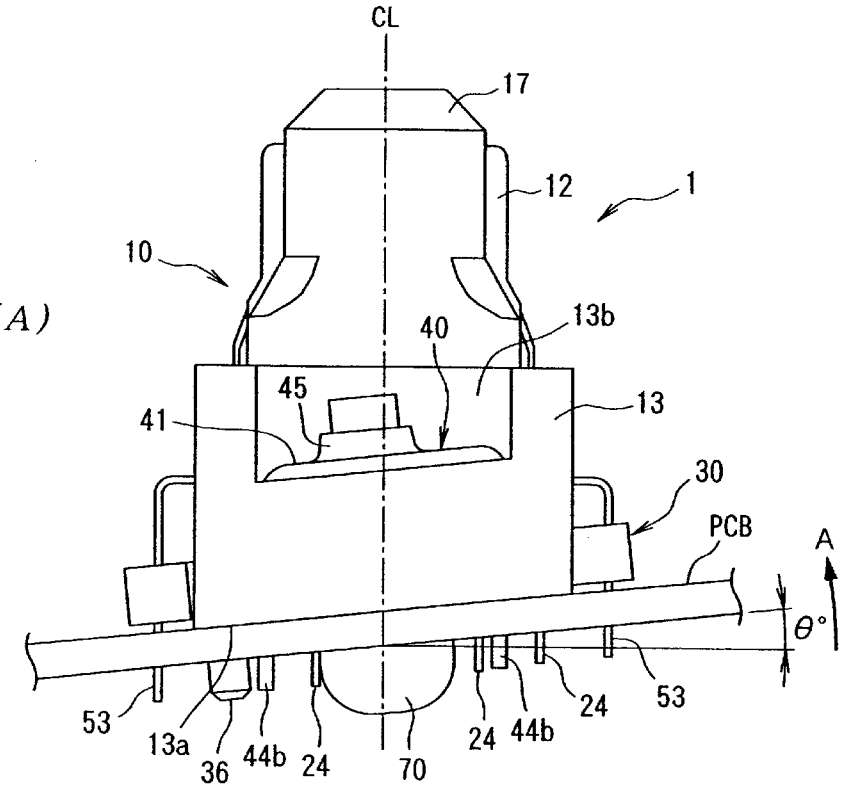
FIG. 7(A) is a right-side view.

Shown in FIGS. 1, 4 and 7, two mating recesses 15 (front and rear) that mate with the mating connector are formed in the mating part 12. A partition plate part 14 extends in the direction of length and is interposed between the mating recesses 15. Numerous contact insertion holes 16 are formed in the front and rear parts of the respective mating recesses 15 at a specified pitch along the direction of length. The respective contact insertion holes 16 communicate with the bottom surface of the base part 11. A pair of guide posts 17, which guide the mating with the mating connector, are formed to protrude from both end portions of the mating part 12 with respect to the direction of length.

Shown in FIG. 7, each of the contacts 20 has a press-fitting part 21 that extends in the direction of mating with the mating connector and is press-fitted in the corresponding contact insertion hole 16 of the housing 10. These contacts 20 may be formed by stamping and forming metal plates. Each contact 20 has an elastic contact part 22 that extends upward from the press-fitting part 21 and protrudes into the mating recess 15 of the housing 10. A transitional part 23 is bent at a right angle to the direction of mating from the lower end of the press-fitting part 21. A leg part 24 is bent from a tip end of the transitional part 23 so that the leg part 24 extends parallel to the direction of mating.

The respective contacts 20 are fastened by press-fitting in the contact insertion holes 16, which are formed in two rows along the direction of length in the respective mating recesses 15 of the housing 10. Then, the leg parts 24 of the contacts 20 are arranged in a staggered configuration along the directions of the respective rows by adjusting the lengths of the transition parts 23, and are inserted into through-holes TH formed in the circuit board PCB after being passed through the through-holes 31 of the leg part alignment plate 30. Furthermore, as is shown most clearly in FIG. 7, the leg parts 24 of the numerous contacts 20 gradually become longer from the rear side toward the front side.

Figure 7B:
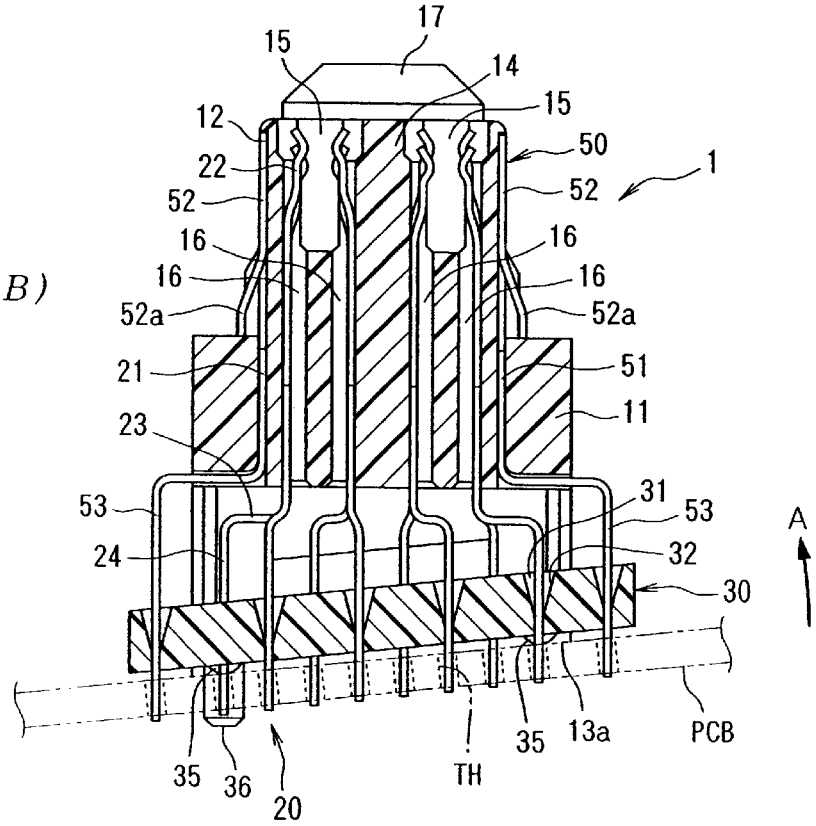
FIG. 7(B) is a sectional view along line 7B—7B in FIG. 1.

The leg part alignment plate 30 consists of a rectangular flat plate that has a plurality of through-holes 31 that align the leg parts 24 of the contacts 20. The leg part alignment plate 30 may be formed by molding an insulating resin. As shown most clearly in FIG. 7(B), tapered surfaces 32, which are used to guide the insertion of the leg parts 24 of the contacts 20, are formed at the upper edges of the through-holes 31 of the leg part alignment plate 30. Referring back to FIG. 1, the two pairs of anchoring arms 33 enter the grooves 11*a* of the housing 10 and allow the movement of the leg part alignment plate 30 in the direction of mating. The anchoring arms 33 are formed so that the anchoring arms 33 protrude upward from the front and rear edges of both end portions of the leg part alignment plate 30 with respect to the direction of length. As shown in FIG. 3, the anchoring projections 34, which enter the spaces between the anchoring projections 11*b* and 11*c* of the housing 10 and temporarily anchor the leg part alignment plate 30, are formed so that the anchoring projections 34 protrude inward from the tip ends of the respective anchoring arms 33. As shown in FIG. 7(B), a plurality of standoffs 35 and two posts 36 are formed to protrude from the under-surface of the leg part alignment plate 30. The standoffs 35 contact the upper surface of the circuit board PCB, and the two posts 36 are inserted into through-holes (not shown) formed in the circuit board PCB to position the leg part alignment plate 30.

Figure 6:
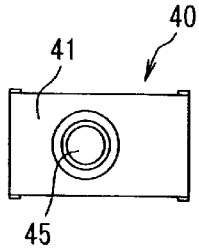
FIG. 6 shows one of the fastening fittings used in the electrical connector shown in FIG. 1.
Figure 6:
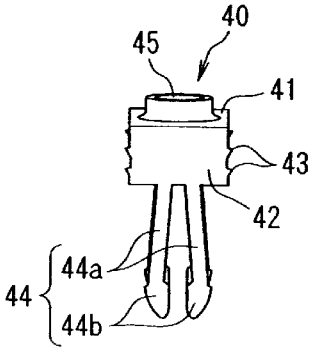
Figure 6:
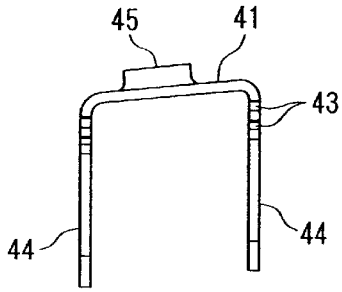
Figure 6:
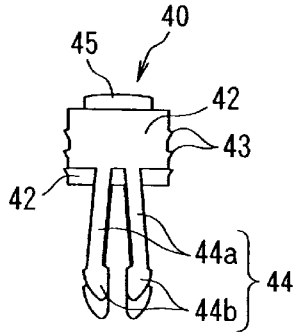

Shown in FIG. 2, each of the fastening fittings 40 has a screw attachment plate part 41, a pair of press-fitting fastening parts 42, and a pair of anchoring leg parts 44. The fastening fittings may be formed by stamping and forming metal plates. The screw attachment plate part 41 extends parallel to the corresponding board attachment face 13*a* of the housing 10 and is carried on the bottom surface 13*c* of the corresponding fastening fitting accommodating recess 13*b*. A female screw part 45 extends perpendicular to the corresponding board attachment face 13*a* and is formed in the approximate center of the screw attachment plate part 41. The press-fitting fastening parts 42 extend downward parallel to the direction of mating with the mating connector from the front and rear ends of the screw attachment plate part 41 and are fastened by press-fitting in the fastening fitting press-fitting through-holes 13*d* of the housing 10. Shown in FIG. 6, barbs 43 used for press-fitting are formed on both side edges of each press-fitting fastening part 42. The anchoring leg parts 44 extend downward from the lower ends of the press-fitting fastening parts 42 parallel to the direction of mating with the mating connector. The anchoring leg parts 44 pass through the fastening fitting press-fitting through holes 13*d* and protrude downward from the corresponding board attachment face 13*a*. As is shown most clearly in FIG. 6, each anchoring leg part 44 is formed by a pair of elastic arms 44*a* that have anchoring parts 44*b* on their tip ends.

The metal shell 50 has a main body part 51, shown in FIG. 7(B), that is disposed inside the base part 11 of the housing 10 in a configuration that surrounds the periphery of the mating part 12. A plurality of tongue parts 52 extend upward from the upper end of the main body part 51 and are disposed on the front and rear faces of the mating part 12. A plurality of pairs of leg parts 53 extend edges of the board attachment faces 13*a* of the housing 10 contact the surface of the circuit board PCB, the circuit board PCB is rotated in the direction indicated by the arrow A in FIGS. 7(A) and 7(B), or the housing 10 is rotated in the opposite direction from the direction indicated by the arrow A, so that the circuit board PCB is disposed along the board attachment faces 13*a* of the housing 10. When this is done, the temporary anchoring state of the anchoring projections 34 is released so that the leg part alignment plate 30 also rotates upward in the direction indicated by the arrow A along with the circuit board PCB. The tapered surfaces 32 of the through-holes 31 of the leg part alignment plate 30 allow the leg part alignment plate 30 to rotate freely about the leg parts 24. Accordingly, the angle formed by the direction of mating with the mating connector and the circuit board PCB becomes $90°-\theta°$, so that the circuit board PCB is anchored by the anchoring parts 44*b* of the fastening fittings 40 in a state in which the direction of mating is inclined with respect to the circuit board PCB. Afterward, the attachment screws 70 are screw-fastened to the female screw parts 45 of the fastening fittings 40 from beneath the circuit board PCB with the circuit board PCB clamped between the attachment screws 70 and the female screw parts 45. As a result, the electrical connector 1 is fastened to the circuit board PCB. Then, the electrical connector 1 is mounted on the circuit board by soldering the leg parts 24 of the contacts 20, the leg parts downward and parallel to the direction of mating after being bent at right angles to the direction of mating from the front and rear lower ends of the main body part 51. The metal shell 50 may be formed by stamping and forming a metal plate. Elastic anchoring parts 52*a*, which contact the surface of the base part 11 of the housing 10 and check the downward movement of the metal shell 50, are installed on the respective tongue parts 52. The leg parts 53 are inserted into through-holes TH formed in the circuit board PCB after being passed through the through-holes 31 formed in the leg part alignment plate 30. As shown most clearly in FIG. 7, the lengths of the leg parts 53 on the front side are longer than the lengths of the leg parts 53 on the rear side. Shown in FIG. 1, electric power terminals 60 are also inserted into through-holes TH formed in the circuit board PCB after being passed through the through-holes 31 formed in the leg part alignment plate 30.

A first example of a method used to mount the electrical connector 1 on the circuit board PCB will now be described with reference to FIG. 7. First, the posts 36 of the leg part alignment plate 30, the leg parts 24 of the numerous contacts 20 aligned by the leg part alignment plate 30, the leg parts 53 of the metal shell 50 and the anchoring leg parts 44 of the fastening fittings 40 are respectively inserted into the through-holes TH of the circuit board PCB along the direction of mating with the mating connector. This insertion is caused to proceed, and when the front 53 of the metal shell 50, and the electric power terminals 60 to the circuit board PCB. The anchoring leg parts 44 of the fastening fittings 40 may also be soldered to the circuit board PCB in order to increase the strength of the attachment of the electrical connector 1 to the circuit board PCB.

In the above-described method of mounting, there is no need to bend the leg parts 24 of the numerous contacts 20 at an inclination to the direction of mating with the mating connector. Accordingly, the location of the contact parts can be controlled and an increase in the manufacturing cost caused by such a bending process can be avoided.

Furthermore, while the board attachment faces 13*a* are inclined by a specified angle of θ° from the plane that is perpendicular to the direction of mating with the mating connector, the leg parts 24 of the contacts 20 extend parallel to the direction of mating. Accordingly, when the circuit board PCB is disposed along the board attachment faces 13*a*, the leg parts 24 of the contacts 20 contact the upper edges of the through-holes TH in the circuit board PCB as shown in FIG. 7(B), causing an acting force to return the circuit board PCB toward the plane that is perpendicular to the mating direction and causing the connector 1 to float up from the circuit board PCB. In this case, the circuit board PCB is anchored by the anchoring parts 44*b* of the fastening fittings 40, and the attachment screws 70 are screw-fastened to the female screw parts 45 of the fastening fittings 40 with the circuit board PCB clamped between the attachment screws 70 and female screw parts 45. Accordingly, the connector 1 does not float up from the circuit board PCB. Furthermore, since the direction of extension of the female screw parts 45 is perpendicular to the board attachment faces 13*a*, the attachment screws 70 can be attached perpendicular to the board attachment faces 13*a*, so that the above-mentioned force that causes the connector 1 to float up from the circuit board PCB can be effectively resisted.

Figure 8A:
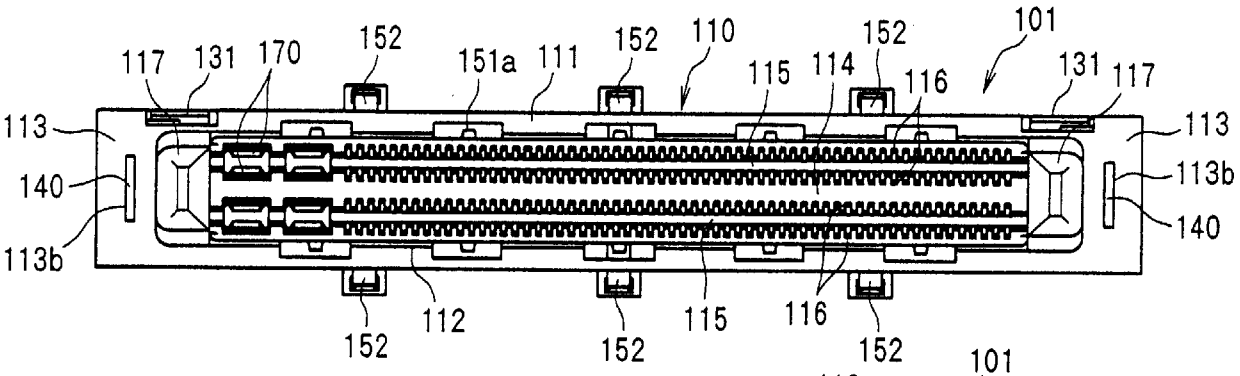
FIG. 8(A) is a plan view.
Figure 8B:
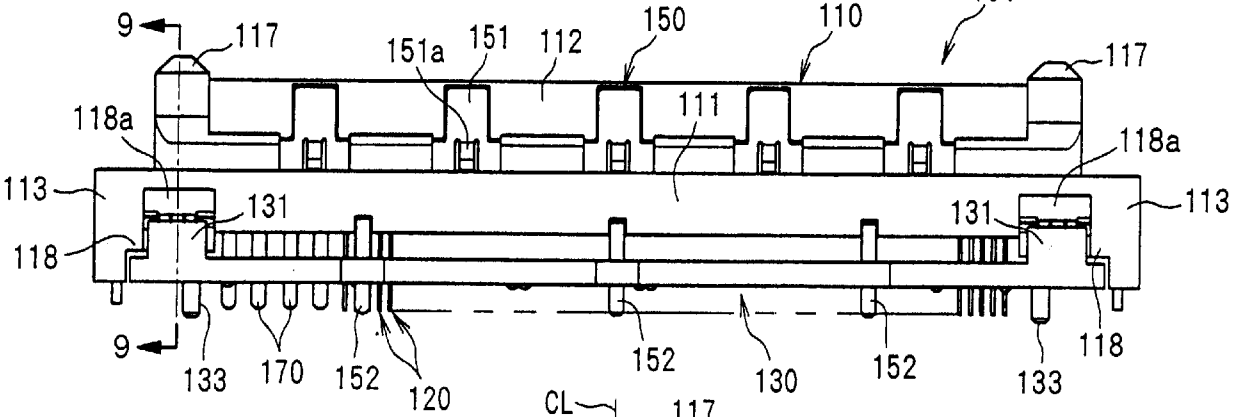
FIG. 8(B) is a front view.
Figure 8C:
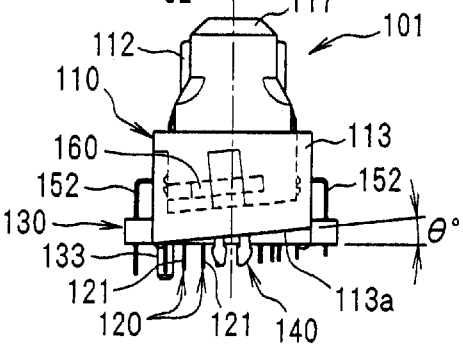
FIG. 8(C) is a right-side view.

A second example of a working configuration of the electrical connector of the present invention will now be described with reference to FIGS. 8 through 12. As is shown in FIG. 8, the electrical connector 101 has a housing 110, numerous contacts 120, a leg part alignment plate 130, a pair of fastening fittings 140, a metal shell 150, and a pair of nuts 160. Here, like the housing 10 shown in FIG. 1, the housing 110 has a substantially rectangular base part 111 that extends in the direction of length (i.e., the left-right direction in FIG. 8(A)), and a substantially rectangular mating part 112 that extends upward from the upper surface of the base part 111. The housing 110 may be formed by molding an insulating resin.

A pair of nut attachment parts 118 protrude downward from the bottom surface of the base part 111 and are disposed on both end portions of the base part 111 with respect to the direction of length. A pair of board attachment parts 113 protrude downward from the bottom surfaces of the nut attachment parts 118 and are disposed on the outsides of both of the nut attachment parts 118 with respect to the direction of length. Board attachment faces 113*a*, formed on a bottom surface of each of the board attachment parts 113, are inclined by a specified angle of θ° with respect to a plane that is perpendicular to the direction of mating with a mating connector (not shown) (i.e., the direction of extension of the central axis CL in FIG. 8(C)). The board attachment faces 113*a* are inclined so that the board attachment faces 113*a* gradually run upward from the front faces of the board attachment parts 113 (i.e., the left faces in FIG. 8(C)) toward the rear faces of the board attachment parts 113. A fastening fitting press-fitting through-hole 113*b* that extends parallel to the direction of mating is formed in the approximate center of each of the board attachment parts 113 with respect to the forward-rearward direction.

Figure 9:
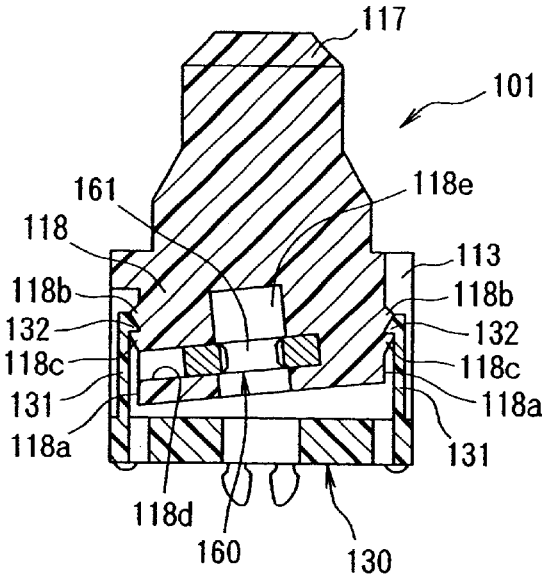
FIG. 9 is a sectional view along line 9—9 in FIG. 8(B).

As shown most clearly in FIG. 9, grooves 118*a* allow the movement of the anchoring arms 131 of the leg part alignment plate 130 along the direction of mating with the mating connector and are formed in the front and rear faces of the respective nut attachment parts 118. Anchoring projections 118*b* and 118*c* are positioned above and below the anchoring projections 132 of the anchoring arms 131 and temporarily anchor the leg part alignment plate 130. The anchoring projections 118*b* and 118*c* are formed so that the projections 118*b* and 118*c* protrude into the respective grooves 118*a*. Furthermore, nut accommodating holes 118*d*, which extend parallel to the bottom surfaces that are formed parallel to the board attachment faces 113*a*, are formed beneath the anchoring projections 118*c* on the front faces of the respective nut attachment parts 118. Screw insertion holes 118*e* are formed in the approximate centers of the bottom surfaces of the respective nut attachment parts 118 so that the screw insertion holes 118*e* are perpendicular to the nut accommodating holes 118*d*.

Shown in FIG. 8 and similar to the mating part 12 shown in FIG. 1, two mating recesses 115 (front and rear mating recesses) that mate with the mating connector are formed in the mating part 112. A partition plate part 114 that extends in the direction of length is interposed between the mating recesses 115. A plurality of contact insertion holes 116 are formed at a specified pitch along the direction of length in the front and rear parts of the respective mating recesses 115. The respective contact insertion holes 116 communicate with the bottom surface of the base part 111. A pair of guide posts 117 guide the mating with the mating connector and are formed so that the guide posts 117 protrude from both end portions of the mating part 112 with respect to the direction of length.

The respective contacts 120 have substantially the same construction and shape as the contacts shown in FIGS. 1, 4 and 7. Each of the contacts 120 has a press-fitting part, an elastic contact part, a transition part and a leg part 121. The leg part 121 is bent from the tip end of the transition part so that the leg part 121 extends parallel to the direction of mating. The leg parts 121 of the contacts 120 are inserted into through-holes (not shown) formed in the circuit board PCB after being passed through through-holes (not shown) formed in the leg part alignment plate 130. Moreover, as shown most clearly in FIG. 12, the leg parts 121 of the numerous contacts 120 show a gradual increase in length from the rear side toward the front side.

The basic construction of the leg part alignment plate 130 is the same as that of the leg part alignment plate 30 shown in FIG. 1. The leg part alignment plate 130 is constructed from a rectangular flat plate having a plurality of through-holes that align the leg parts 121 of the contacts 120. The leg part alignment plate 130 may be formed by molding an insulating resin. Shown in FIGS. 1 and 9, two pairs of anchoring arms 131 enter the grooves 118*a* of the housing 110 and allow the leg part alignment plate 130 to move in the direction of mating. The anchoring arms 131 are formed so that the anchoring arms 131 protrude upward on the front and rear edges of both end portions of the leg part alignment plate 130 with respect to the direction of length. As shown in FIG. 9, anchoring projections 132 enter the spaces between the anchoring projections 118*b* and 118*c* of the housing 110 and temporarily anchor the leg part alignment plate 130 and are formed to protrude inward from the tip ends of the respective anchoring arms 131. A plurality of standoffs (not shown) is formed to protrude from the under-surface of the leg part alignment plate 130. The standoffs contact the upper surface of the circuit board PCB, and the two posts 133 are inserted into through-holes formed in the circuit board PCB to position the leg part alignment plate 130.

Figure 10:
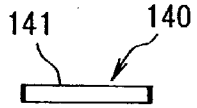
FIG. 10 shows one of the fastening fittings used in the electrical connector shown in FIG. 8.
Figure 10:
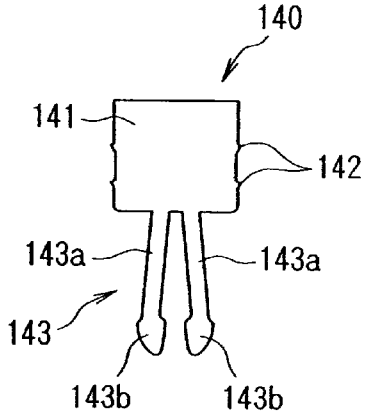
Figure 10:
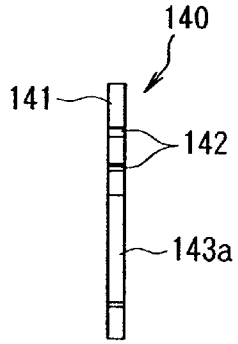

As shown in FIG. 10, each of the fastening fittings 140 has a rectangular flat-plate-form press-fitting part 141 and an anchoring leg part 143 that extends downward from the press-fitting part 141. The fastening fittings 140 may be formed by stamping metal plates. The press-fitting part 141 is press-fitted in a corresponding fastening fitting press-fitting through-hole 113*b* formed in the housing 110 shown in FIG. 8(A). Press-fitting barbs 142 are formed on both side edges of the press-fitting part 141. The anchoring leg part 143 is formed by a pair of elastic arms 143*a* that have anchoring parts 143*b* disposed on their tip ends. The anchoring leg part 143 protrudes downward from the corresponding board attachment face 113*a* when the fastening fitting 140 is press-fitted.

Figure 12:
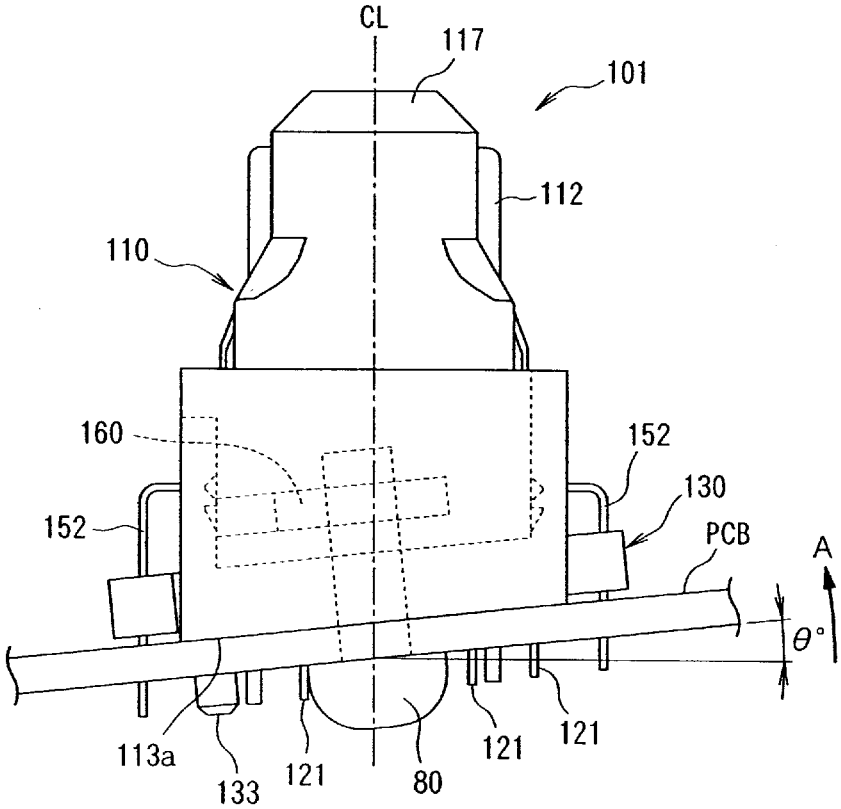
FIG. 12 is a right-side view showing a state in which the electrical connector shown in FIG. 8 is mounted on a circuit board.

The metal shell 150 has substantially the same construction as the metal shell 50 shown in FIGS. 1 and 7. Shown in FIG. 8, the metal shell 150 has a main body part (not shown) that is disposed inside the base part 111 of the housing 110 in a configuration that surrounds the periphery of the mating part 112. A plurality of tongue parts 151 extend upward from the upper end of the main body part and are disposed on the front and rear faces of the mating part 112. A plurality of pairs of leg parts 152 extend downward and parallel to the direction of mating after being bent at right angles to the direction of mating from the front and rear lower ends of the main body part. An elastic anchoring part 151*a*, which contacts the surface of the base part 111 of the housing 110 and checks the downward movement of the metal shell 150, is disposed on each tongue part 151. The leg parts 152 are inserted into through-holes formed in the circuit board PCB after being passed through through-holes formed in the leg part alignment plate 130. As shown in FIG. 12, the lengths of the leg parts 152 on the front side are longer than the lengths of the leg parts 152 on the rear side.

Figure 11:
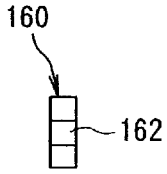
FIG. 11 shows one of the nuts used in the electrical connector shown in FIG. 8.
Figure 11:
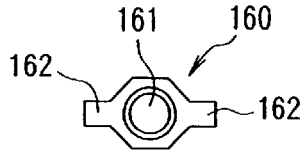
Figure 11:
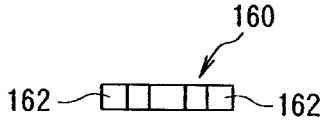

As shown in FIG. 11, each nut 160 has a female screw part 161 in the center and a pair of ear parts 162 on both ends. As shown most clearly in FIG. 9, the respective nuts 160 are inserted and fastened inside the nut accommodating holes 118*d* from the front surfaces of the nut attachment parts 118 so that the female screw parts 161 of the nuts communicate with the screw insertion holes 118*e*. As a result, the nuts 160 are inclined by a specified angle of θ° from the plane that is perpendicular to the direction of mating with the mating connector, and the direction of extension of the female screw parts 161 is perpendicular to the board attachment faces 113*a*. Shown in FIG. 8, electric power terminals 170 are also inserted into through-holes formed in the circuit board PCB after being passed through through-holes formed in the leg part alignment plate 130.

A second example of a method used to mount the electrical connector 101 on the circuit board PCB will now be described with reference to FIG. 12. First, the posts 133 of the leg part alignment plate 130, the leg parts 121 of the numerous contacts 120 aligned by the leg part alignment plate 130, the leg parts 152 of the metal shell 150, and the anchoring leg parts 143 of the fastening fittings 140 are respectively inserted into the through-holes of the circuit board PCB along the direction of mating with the mating connector. This insertion is caused to proceed, and when the front edges of the board attachment faces 113*a* of the housing 110 contact the surface of the circuit board PCB, the circuit board PCB is rotated in the direction indicated by the arrow A in FIG. 12, or the housing 110 is rotated in the opposite direction from the direction indicated by the arrow A, so that the circuit board PCB is disposed along the board attachment faces 113*a* of the housing 110. When this is done, the leg part alignment plate 130 also rotates upward in the direction indicated by the arrow A along with the circuit board PCB. Accordingly, the angle formed by the direction of mating with the mating connector and the circuit board PCB becomes 90°−θ°, so that the circuit board PCB is anchored by the anchoring parts 143*b* of the fastening fittings 140 in a state in which the direction of mating is inclined with respect to the circuit board PCB. Afterward, the attachment screws 80 are screw-fastened to the female screw parts 161 of the nuts 160 from beneath the circuit board PCB with the circuit board PCB clamped between the attachment screws 80 and the female screw parts 161. As a result, the electrical connector 101 is fastened to the circuit board PCB. Then, the electrical connector 101 is mounted on the circuit board PCB by soldering the leg parts 121 of the contacts 120, the leg parts 152 of the metal shell 150 and the electric power terminals 170 to the circuit board. The anchoring leg parts 143 of the fastening fittings 140 may also be soldered to the circuit board PCB.

In the above-described method of mounting, as well as in the first working configuration, there is no need to bend the leg parts 121 of the numerous contacts 120 at an inclination to the direction of mating with the mating connector. Accordingly, the location of the contact parts can be controlled and an increase in the manufacturing cost caused by such a bending process can be avoided.

Furthermore, when the circuit board PCB is disposed along the board attachment faces 113*a*, an acting force causes the electrical connector 101 to float up from the circuit board PCB. However, since the circuit board PCB is anchored by the anchoring parts 143*b* of the fastening fittings 140, and the attachment screws 80 are screw-fastened to the female screw parts 161 of the nuts 160 with the circuit board PCB clamped between the attachment screws 80 and the female screw parts 161, the connector 101 does not float up from the circuit board PCB. Furthermore, since the direction of extension of the female screw parts 161 is perpendicular to the board attachment faces 113*a*, the attachment screws 80 can be attached perpendicular to the board attachment faces 113*a*, so that the above-mentioned force that causes the connector 101 to float up from the circuit board PCB can be effectively resisted.

Figure 13:
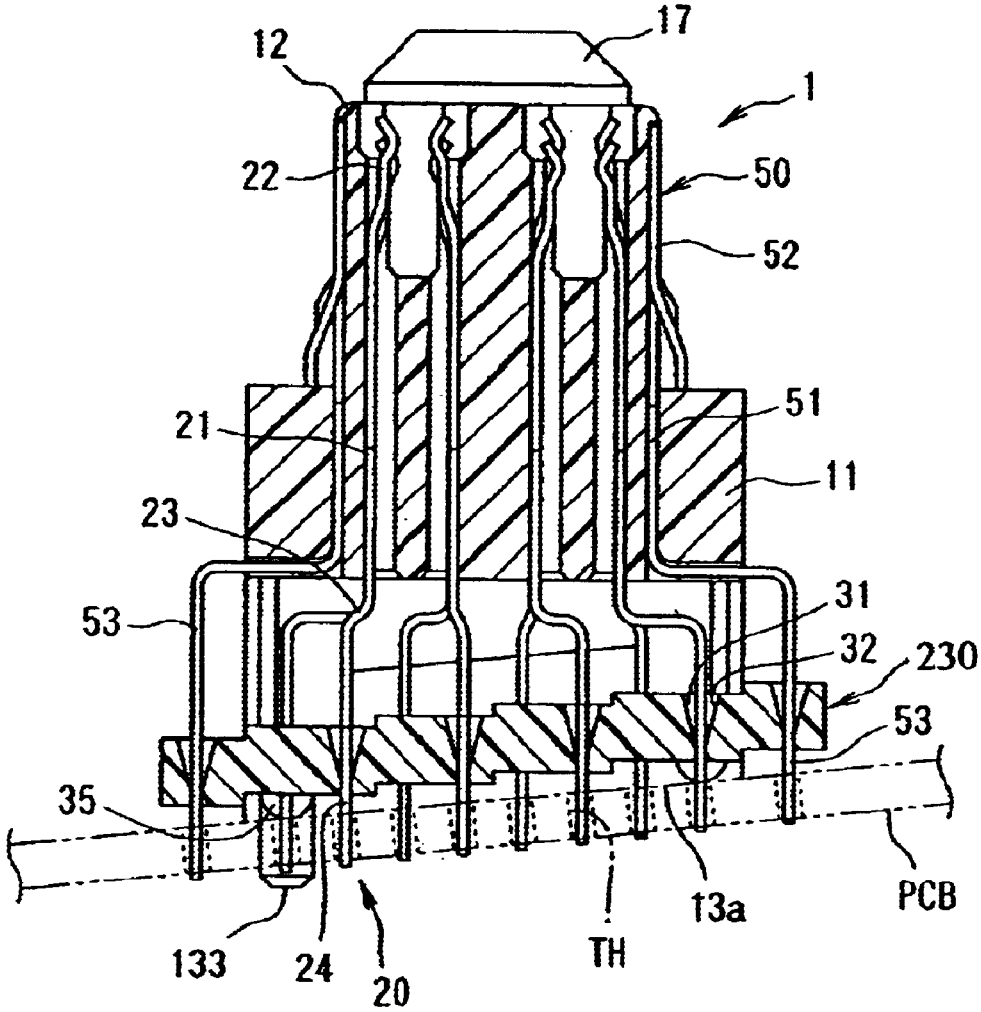
FIG. 13 is a sectional view of an electrical connector using a modified example of the leg part alignment plate.
Figure 14:
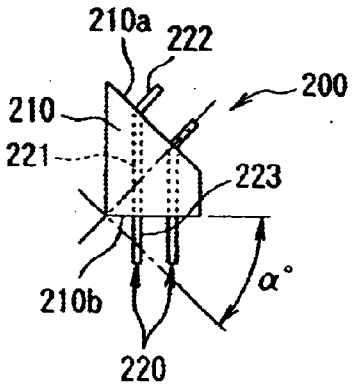
FIG. 14 (A) PRIOR ART
FIG. 14 shows a first example of an electrical connector of the prior art.
Figure 14:
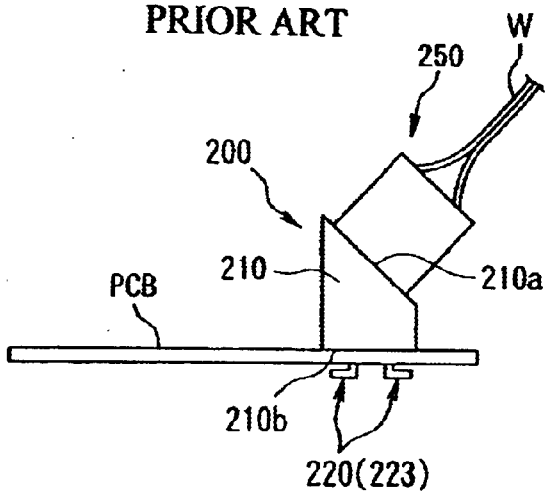
FIG. 14 (B) PRIOR ART
Figure 15:
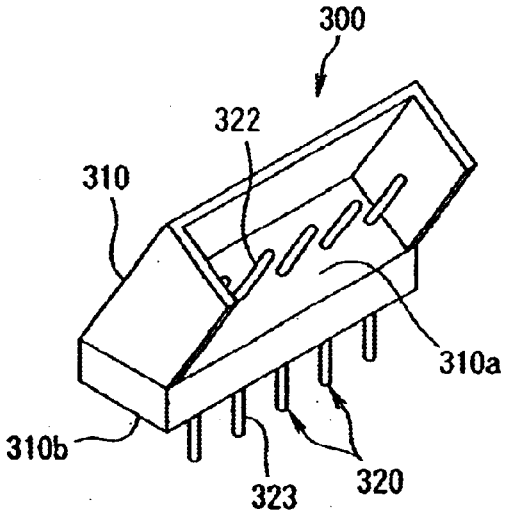
FIG. 15 (A) PRIOR ART
FIG. 15 shows a second example of an electrical connector of the prior art.
Figure 15:
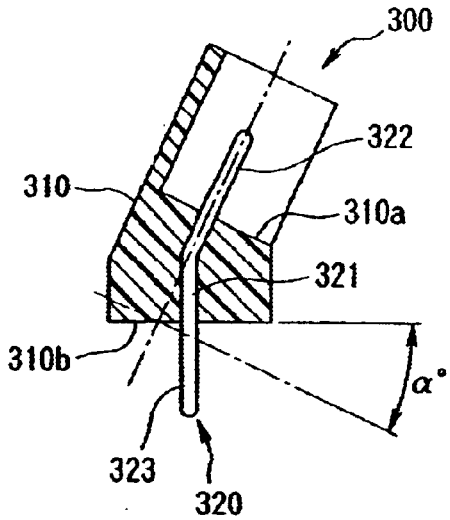
FIG. 15 (B) PRIOR ART

Although working configurations of the present invention have been described above, the present invention is not limited to these working configurations. Various alterations are possible. For example, although the leg part alignment plate 30 used in the first working configuration is constructed as a rectangular flat plate, it would also be possible to form the leg part alignment plate 30 with a step-form part. As shown in FIG. 13, leg part alignment plate 230 is gradually stepped up in cross section from the side of the center of rotation of the circuit board PCB (i.e., the front side) toward the opposite side (i.e., the rear side) in accordance with the lengths of the leg parts 24, 53 in a state in which the circuit board PCB is disposed along the board attachment faces 13*a*. The through-holes 31 are formed to extend in the direction of mating in the respective steps. In this way, the lengths of the leg parts 24, 53 that protrude from the under-surface of the leg part alignment plate 30 can be made substantially constant, so that the relatively long leg parts 24, 53 positioned on the front side (i.e., the left side in FIG. 13) can be effectively protected. Furthermore, instead of using a step shape, it would also be possible to form at least the bottom surface of the leg part alignment plate 30 as a flat surface that is inclined parallel to the upper surface of the circuit board PCB following mounting. Moreover, the leg part alignment plate 130 used in the second working configuration may also be formed with a step form part similar to that of the leg part alignment plate 230 shown in FIG. 13.

We claim:

1. An electrical connector comprising:

a housing having a board attachment face inclined by a specified angle from a plane that is perpendicular to a direction of mating with a mating connector;

contacts connected to the housing and having leg parts that extend parallel to the direction of mating that are inserted into first through-holes in a circuit board;

a leg part alignment plate having second through-holes that align the leg parts and is movable along the direction of mating;

a fastening fitting having a screw attachment plate part that extends parallel to the board attachment face and a female screw part that extends perpendicular to the board attachment face; and an anchoring leg part that is connected to the screw attachment plate part and extends parallel to the direction of mating.

2. The electrical connector of claim 1, wherein the leg parts vary in length such that a length of the leg parts protruding from the leg part alignment plate is kept substantially constant.

3. The electrical connector of claim 1, wherein the housing has screw insertion holes formed parallel to the direction of mating that communicate with the female screw parts.

4. The electrical connector of claim 1, wherein the leg part alignment plate is constructed as a step-form part.

5. The electrical connector of claim 1, wherein the leg part alignment plate has a bottom surface inclined parallel to the circuit board after mounting.

6. The electrical connector of claim 1, wherein the second through-holes have a tapered surfaces.

7. An electrical connector comprising:

a housing having a board attachment face inclined by a specified angle from a plane that is perpendicular to a direction of mating with a mating connector;

contacts connected to the housing and having leg parts that extend parallel to the direction of mating that are inserted into first through-holes in a circuit board;

a leg part alignment plate having second through-holes that align the leg parts and is movable along the direction of mating;

a fastening fitting having a screw attachment plate part that extends parallel to the board attachment face and a female screw part that extends perpendicular to the board attachment face and is formed in an approximate center of the screw attachment plate part; and an anchoring leg part that is connected to the screw attachment plate part and extends parallel to the direction of mating.

8. The electrical connector of claim 7, wherein the leg parts vary in length such that a length of the leg parts protruding from the leg part alignment plate is kept substantially constant.

9. The electrical connector of claim 8, wherein the housing has screw insertion holes formed parallel to the direction of mating that communicate with the female screw parts.

10. The electrical connector of claim 8, wherein the leg part alignment plate is constructed as a step-form part.

11. The electrical connector of claim 8, wherein the leg part alignment plate has a bottom surface inclined parallel to the circuit board after mounting.

12. An electrical connector comprising:

a housing having a board attachment face inclined by a specified angle from a plane that is perpendicular to a direction of mating with a mating connector and a nut accommodating hole that extends parallel to the board attachment face;

contacts connected to the housing and having leg parts that extend parallel to the direction of mating that are inserted into first through-holes in a circuit board;

a leg part alignment plate having second through-holes with tapered surfaces that align the leg parts and is movable along the direction of mating; and a nut having a female screw part that is oriented in a direction that extends perpendicular to the board attachment face when the nut is inserted into the nut accommodating hole.

13. The electrical connector of claim 12, wherein the leg parts vary in length such that a length of the leg parts protruding from the leg part alignment plate is kept substantially constant.

14. The electrical connector of claim 13, wherein the leg part alignment plate is constructed as a step-form part.

15. The electrical connector of claim 12, wherein the leg part alignment plate is constructed as a step-form part.

* * * * *